United States Patent [19]

Beer

[11] 4,425,217

[45] Jan. 10, 1984

[54] ANODE WITH LEAD BASE AND METHOD OF MAKING SAME

[75] Inventor: Henri B. Beer, Heide Kalmthout, Belgium

[73] Assignee: Diamond Shamrock Corporation, Dallas, Tex.

[21] Appl. No.: 293,384

[22] Filed: Aug. 17, 1981

[30] Foreign Application Priority Data

Aug. 18, 1980 [GB] United Kingdom ..... 8026832

[51] Int. Cl.[3] ..... C25B 11/08; C25B 11/10; C25B 11/02

[52] U.S. Cl. ..... 204/290 F; 204/290 R

[58] Field of Search ..... 204/290 R, 290 F, 291, 204/292, 293

[56] References Cited

U.S. PATENT DOCUMENTS

| | | | |
|---|---|---|---|
| 3,632,498 | 1/1972 | Beer | 204/290 F |
| 3,691,052 | 9/1972 | Langley | 204/290 F |
| 3,775,284 | 11/1973 | Bennett | 204/290 F |
| 3,926,773 | 12/1975 | Koziol et al. | 204/290 F |
| 3,933,616 | 1/1976 | Beer | 204/290 F |
| 4,134,806 | 1/1979 | DeNora et al. | 204/105 R |
| 4,290,859 | 9/1981 | Oda et al. | 204/16 |

FOREIGN PATENT DOCUMENTS 313312 2/1974 Austria .

*Primary Examiner*—F. Edmundson

*Attorney, Agent, or Firm*—John P. Hazzard; Woodrow W. Ban; Bruce E. Harang

[57] ABSTRACT

An anode with a base of lead or lead alloy is provided with catalytic particles of titanium which comprise a very small amount of platinum group metal or an oxide thereof.

These catalytic particles are partly embedded, anchored and electrically connected to the base, so that oxygen is evolved on these particles at a reduced potential at which the underlying lead or lead alloy of the base remains electrochemically inactive, and the anode base thereby serves only as a stable conductive support to the catalytic particles.

Operation of this anode at a reduced potential provides energy savings. It may be used more particularly in cells for electrowinning metals with a higher degree of purity at a reduced energy cost with respect to conventional cells equipped with anodes consisting of lead or a lead alloy.

3 Claims, No Drawings

ANODE WITH LEAD BASE AND METHOD OF MAKING SAME

TECHNICAL FIELD

The present invention relates to dimensionally stable electrodes, and more particularly to anodes for oxygen evolution in an acid electrolyte, such as is used e.g. in processes for electrowinning metals from acid electrolytes.

BACKGROUND ART

Lead or lead alloy anodes have been widely used in processes for electrowinning metals from sulphate solutions. They nevertheless have important limitations, such as a high oxygen overvoltage and loss of the anode material leading to contamination of the electrolyte, as well as the metal product obtained on the cathode.

Anodes of lead-silver alloy provide a certain decrease of the oxygen overvoltage and improvement of the current efficiency, but they still have the said limitations as a whole.

It has been proposed to use dimensionally stable titanium anodes with a platinum metal oxide coating for anodic evolution of oxygen, but such anodes are generally subject to more or less rapid passivation and oxidation of the titanium base.

It has also been proposed to provide the titanium base with a protective undercoating comprising a platinum group metal beneath the outer coating, but they generally do not provide sufficient protection to justify the high cost of using precious metals.

Metal electrowinning cells generally require a large anode surface in order to ensure an even electrodeposition on the cathode, so that the cost of using a titanium base must also be taken into account.

Dimensionally stable anodes with mixed oxide coatings comprising platinum group metals and valve metals are described in U.S. Pat. No. 3,632,498. An example of this patent relates to the preparation of a fine Ti-Pd mixed oxide powder which is then applied by rolling or hammering into a rod of soft-quality titanium. However, the amount of precious metal incorporated in the mixed oxide powder and applied to the electrode in this manner could be prohibitive for various industrial applications. Thus, when the electrode surface is to be substantially covered with the mixed oxide powder, and more particularly when the electrode is intended for operation at a relatively low current density such as is used in metal electrowinning, the cost of precious metal thus applied in the form of a mixed oxide may be especially prohibitive.

DISCLOSURE OF INVENTION

An object of the invention is to provide an improved anode for evolving oxygen in an acid electrolyte.

Another object of the invention is to provide an anode with a base of lead or lead alloy with improved electrochemical performance for anodically evolving oxygen in an acid electrolyte, so as to be able to substantially avoid loss of the anode material, whereby to avoid said limitations of conventional lead or lead alloy anodes.

A further object of the invention is to provide a simple method of making such an anode with improved performance.

These objects are essentially met by the invention as set forth in the claims.

The electrochemical performance of the anode is improved in accordance with the invention by providing the anode with catalytic particles consisting of valve metal comprising a catalyst for oxygen evolution, said particles being partly embedded at the surface of the anode base of lead or lead alloy, so that they are firmly anchored and electrically connected to the base. The remaining, non-embedded part of said catalytic particles thus projects from said surface of the anode base, and thereby can present a surface for oxygen evolution which can be considerably larger than the underlying surface of the anode base of lead or lead alloy. Said partly embedded catalytic particles are advantageously arranged according to the invention, so that they substantially cover the entire surface of the lead or lead alloy base, or at least cover a major part thereof, and so that they can thereby present a large surface for oxygen evolution, with a substantially uniform distribution of the anode current density.

The catalyst for oxygen evolution on the catalytic particles arranged on a lead or lead alloy base in accordance with the invention may advantageously consist of any suitable metal of the platinum group, either in the form of an oxide or in metallic form. Iridium, ruthenium, platinum, palladium, and rhodium may be advantageously used to provide an oxygen evolution catalyst on valve metal particles in accordance with the invention.

The valve metals preferably used to provide said catalytic particles applied to the anode according to the invention are: titanium, zirconium, tantalum or niobium. Titanium powder may be advantageously used to provide said catalytic particles at a relatively low cost, while titanium sponge has a considerably lower cost and hence may be preferred for economic reasons.

The catalytic particles applied according to the invention may have a size lying in the range between 75 and 850 microns, and preferably in the range of about 150–600 microns.

The amount or loading of said catalytic particles applied according to the invention per unit area of the anode base should generally be adequate to substantially cover the the anode base, will depend on the size of the catalytic particles applied to the base, and may lie in the range between about 50 $g/m^2$ and about 500 $g/m^2$. A loading of catalytic particles corresponding to 150–300 $g/m^2$ may be adequate in most cases for carrying out the invention. A very small amount of catalyst for oxygen evolution may be evenly applied to valve metal particles, so as to provide said catalytic particles in accordance with the invention with a very large surface comprising a very small proportion of said catalyst, which may advantageously correspond to 0.3%–6% by weight of the valve metal in said particles. A minimum amount of said catalyst may thus be evenly distributed on a very large surface of the catalytic particles on which oxygen is evolved, thus ensuring particularly effective and economical use of the catalyst. On the other hand, the use of catalytic particles with considerably higher proportions of platinum group metals than are indicated above for the catalyst may well render the use of such precious metals as catalysts prohibitive for most practical purposes. As may be seen from the examples further below, the method according to the invention as set forth in the claims allows platinum group metal compounds to be very simply applied to valve metal particles and next thermally decomposed so as to convert them to a suitable catalyst for oxygen evolution.

According to one variant, the method of making an anode according to the invention comprises partly embedding valve metal particles in the anode base and then applying the catalyst for oxygen evolution as described below and set forth in the claims. This subsequent application of the catalyst to the partly embedded valve metal particles may be readily carried out on the anode during its manufacture, and also whenever it may become necessary to recover the desired electrochemical performance after operation of the anode for some time.

BEST MODE OF CARRYING OUT THE INVENTION

The following examples illustrate different modes of carrying out the invention and the advantages resulting therefrom, with reference to the accompanying tables.

EXAMPLE 1

An anode sample AL1 was prepared from a lead plate (20×15×1.5 mm) in the following manner.

The lead plate surface was pretreated with a 50/50 mixture of acetone and carbon tetrachloride, followed by etching in 10% nitric acid.

Titanium powder with a particle size lying in the range between 150 and 300 microns was pretreated by etching by 10% oxalic acid at 90° C. for 30 minutes, washed with distilled water, dried at 80° C. in air for 15 minutes, and was then activated and applied as follows:

(i) An activating solution AS1 was prepared, comprising 0.2 g IR $Cl_3$ aq., 0.1 g Ru $Cl_3$ aq., 0.4 cc HCl 12 N and 6 cc ethanol.

(ii) After thoroughly mixing 5 grams of the titanium powder with the activating solution, the excess liquid was drained off and the remaining wet powder was slowly dried in air.

(iii) The dry powder thus obtained was next heat treated at 500° C. for 30 minutes in air in a closed furnace, so as to convert the noble metal salts applied to the titanium powder particles into an electrocatalytically active oxide.

(iv) Activated titanium powder thus obtained was then uniformly distributed over the lead plate so as to substantially cover its entire surface with the activated particles.

(v) The activated titanium powder particles thus arranged uniformly on the lead plate were finally pressed by carefully hammering them into the underlying lead, until they were partly embedded and firmly anchored in the lead plate.

The amount of activated titanium powder thus applied per unit area of the lead plate corresponded to about 150 g Ti/m$^2$, 0.5 g Ir/m$^2$, and 0.21 g Ru/m$^2$ in this case.

The catalytically activated lead anode sample AL1 thus obtained was electrolytically tested as an oxygen-evolving anode in an electrolytic cell containing 5% $H_2SO_4$ and having a lead cathode.

The anode potential (AP) of this sample AL1 as determined in 5% $H_2SO_4$ at 20°-25° C. with respect to a normal hydrogen electrode at different anode current densities (ACD) is given in Table 1.

The cell voltage (Vc) determined for sample AL1 operating in two different acid electrolytes which each contained 200 gpl $ZnSO_4$ and respectively contained 180 gpl and 18 gpl $H_2SO_4$, is also shown at different anode current densities ACD in Table 1.

The anode sample AL1 was further subjected to an accelerated lifetime test in 5% $H_2SO_4$ at 20°-25° C. It operated for one month at 2500 A/m$^2$ without exhibiting any increase of its potential, followed by a further month of operation at 1000 A/m$^2$, likewise without exhibiting any notable increase of the anode potential.

As a basis for comparison with sample AL1, a lead reference sample L1 consisting of a similar lead plate without any catalytic particles was electrolytically tested in the same way as sample AL1 and Table 1 likewise shows the corresponding test data.

The last column in Table 1 indicates the test time, which is underlined to indicate anode failure.

As a further basis for comparison, a titanium reference sample AT1 was prepared by pretreating a titanium plate with oxalic acid in the same way as described above for the titanium powder and coating it by applying 4 layers of the activating solution AS1 described above under (i), then drying and heat treating each applied layer as described above under (iii).

Table 1 likewise shows test data for this reference sample AT1, namely AP as a function of ACD in 5% $H_2SO_4$.

TABLE 1

| | | EXAMPLE 1 PREPARATION | | | | TEST | | | | |
|---|---|---|---|---|---|---|---|---|---|---|
| REFERENCE | BASE | VM Particles (g/m$^2$) | CATALYST (g/m$^2$) | Activating Solution | Heat Treatment (°C./minutes) | ELECTROLYTE | ACD (A/m$^2$) | AP (V/NHE) | VC (V) | Time (days) |
| AL1 | Pb | 150 Ti (150-300μ) | 0.50 Ir 0.21 Ru | 1× AS1 | 500/30 | $H_2SO_4$ 5%, 20-25° C. | 200 | 1.40 | | 30* |
| | | | | | | | 500 | 1.48 | | 30* |
| | | | | | | | 1000 | 1.58 | | |
| | | | | | | | 2500 | | | |
| | | | | | | | 1000 | | | |
| | | | | | | $ZnSO_4$ 200 g/l | 200 | | 2.43 | |
| | | | | | | $H_2SO_4$ 180 g/l | 500 | | 2.57 | |
| | | | | | | | 1000 | | 2.71 | |
| | | | | | | $ZnSO_4$ 200 g/l | 200 | | 2.55 | |
| | | | | | | $H_2SO_4$ 18 g/l | 500 | | 3.00 | |
| L1 | Pb | — | — | — | — | $H_2SO_4$ 5%, 20-25° C. | 200 | 1.62 | | 4 |
| | | | | | | | 500 | 1.68 | | |
| | | | | | | | 1000 | 1.83 | | |
| | | | | | | | 2500 | | | |
| | | | | | | $ZnSO_4$ 20 g/l | 100 | | 2.60 | |
| | | | | | | $H_2SO_4$ 180 g/l | 200 | | 3.00 | |
| | | | | | | $ZnSO_4$ 20 g/l | 100 | | 2.76 | |

TABLE 1-continued

| REFERENCE | BASE | VM Particles ($g/m^2$) | CATALYST ($g/m^2$) | EXAMPLE 1 PREPARATION Activating Solution | Heat Treatment (°C./minutes) | TEST ELECTROLYTE | ACD ($A/m^2$) | AP (V/NHE) | VC (V) | Time (days) |
|---|---|---|---|---|---|---|---|---|---|---|
| AT1 | Ti | — | 0.50 Ir 0.21 Ru | 4× AS1 | 4× 500/30 | $H_2SO_4$ 18 g/l $H_2SO_4$ 5%, | 350 200 500 1000 2500 | 1.34 1.45 1.50 | 3.00 | 28 |

TABLE 2

| REFERENCE | BASE | VM Particles ($g/m^2$) | CATALYST ($g/m^2$) | EXAMPLE 2 PREPARATION Activating Solution | Heat Treatment (°C./minutes) | TEST ELECTROLYTE | ACD ($A/m^2$) | AP (V/NHE) | VC (V) | Time (days) |
|---|---|---|---|---|---|---|---|---|---|---|
| AL2 | Pb | 150 Ti (sponge, 420μ) | 2.4 Ru | 1× AS2 | 500/30 | industrial 35° C. | 400 | 1.75 −1.90 | | 45 |
| L2 | Pb-0.5% Ag | — | — | — | — | industrial 35° C. | 400 1.95 | −1.97 | 60 | |

EXAMPLE 2

An anode sample AL2 was prepared and tested as described in Example 1, unless otherwise indicated below.

Titanium sponge particles were used in this case, which had a particle size of about 420 microns, were activated and applied as follows:

(i) An activating solution AS2 used in this case comprised 0.5 g Ru $Cl_3$ aq., 0.4 cc HCl 12 N and 6 cc ethanol.

(ii) 1 cc of this activating solution AS2 was mixed with 2 grams of the titanium sponge which took up the 1 cc solution entirely, with no excess liquid.

The lead sample AL2, obtained after drying, heat treating and applying the titanium sponge as described in Example 1, comprised 150 g Ti/$m^2$ and 2.4 g Ru/$m^2$. It was tested as an oxygen-evolving anode in an electrolyte which is used for industrial electrowinning of zinc, comprising 180 gpl $H_2SO_4$, 40–50 gpl Zn, 5 gpl Mn and 7 gpl Mg. The anode sample AL2 operating at 400 A/$m^2$ in this industrial electrolyte at 35° C. exhibited an anode potential (AP) which was initially 1.75 V/NHE and 1.92 V/NHE after 45 days of operation without anode failure.

As a basis for comparison of the sample AL2, a lead alloy reference electrode L2 consisting of a plate of Pb-0.5% Ag alloy was tested under the same conditions as sample AL2. This lead alloy reference sample L2 operated at 400 A/$m^2$ and 35° C. in the same industrial electrolyte, exhibited an initial anode potential of 1.95 V/NHE (200 mV higher than for the activated sample AL2) and a potential increase to 1.965 V/NHE after operating for 2 months under these conditions.

Table 2 below shows the corresponding data.

TABLE 3

| REFERENCE | BASE | VM Particles ($g/m^2$) | CATALYST ($g/m^2$) | EXAMPLES 3 to 9 PREPARATION Activating Solution | Heat Treatment (°C./minutes) | TEST ELECTROLYTE | ACD ($A/m^2$) | AP (V/NHE) | VC (V) | Time (days) |
|---|---|---|---|---|---|---|---|---|---|---|
| AL3 | Pb | 150 Ti (sponge, 400μ) | 5 Ru | 4× AS3 | 4× 320/15 + 320/240 | industrial | 400 | 1.48 −1.65 | | 35* |
| AL4 | Pb | 150 Ti (sponge, 400μ) | 5 Ru | 1× AS4 +3× AS3 | 500/30 3× 320/15 + 320/240 | industrial | 400 | 1.47 −1.55 | | 25* |
| AL5 | Pb | 150 Zr (appr. 420μ) | 5.5 Ru | 4× AS2 | 4× 320/15 + 320/240 | industrial | 400 | 1.50 | | 3 |
| AL6 | Pb | 150 Ti 300–400μ | 5 Ru | 4× AS6 | 4× 320/30 + 320/240 | industrial | 400 | 1.46 −1.52 | | 20* |
| AL7 | Pb | 150 Ti* 430μ | 5.5 Ru | 1× AS7 4× AS6 | 500/30 + 4× 320/30 + 320/240 | industrial | 400 | 1.46 −1.47 | | 16* |
| AL8 | Pb | 75 Ti (400–450μ) | 2 Pt/Ir | 1× AS8 | 480/30 $NH_3$/butane atmosphere | $H_2SO_4$ 10% | 2500 | | | 5* |
| AL9 | Pb-0.5% Ag | 40–50 Zr 105–840μ | 5 Pt | — | — | industrial | 400 | 1.50 −1.59 | | 9* |

EXAMPLE 3

An anode sample AL3 was prepared in the following manner from a lead plate (20×15×1.5 mm) pretreated as in Example 1.

Ti sponge particles with a size of about 400 microns were pretreated by etching with oxalic acid as in Example 2 and applied with a loading of 150 g Ti/m$^2$ to the lead plate in the manner described in Example 1 under (iv) and (v).

An activating solution AS3 comprising 0.5 g Ru $Cl_3$ aq., 0.4 cc HCl and 6 cc ethanol was then applied with a brush in 4 successive layers to the lead plate covered with titanium sponge particles. Each layer of solution AS3 thus applied was slowly dried and then heat treated at 320° C. for 15 minutes in air, while a final prolonged common heat treatment was effected at 320° C. for 240 minutes in air.

The lead sample AL3 thus prepared had a ruthenium loading corresponding to 5 g Ru/m$^2$, and was likewise tested in an industrial electrolyte in the manner described in Example 2; it exhibited an initial anode potential AP at 400 A/m$^2$ of 1.48 V/NHE, which increased to 1.65 V/NHE after 35 days of operation, without anode failure.

Table 3 shows the corresponding data for sample AL3.

EXAMPLE 4

An anode sample A14 was prepared in the following manner from a lead plate (20×15×1.5 mm) pretreated as in Example 1.

2 g of titanium sponge particles with a size of about 400 microns were pretreated by etching with oxalic acid as in Example 2, mixed with 1 cc of an activating solution AS4 comprising 0.1 g Ru $Cl_3$ aq., 0.3 g butyltitanate, 0.04 cc HCl and 6 cc isopropylalcohol, dried, heat treated at 500° C. for 30 minutes in air, and then applied with a loading of 150 g/m$^2$ to the pretreated lead plate in the manner described in Example 1 under (iv) and (v).

An activating solution AS3 with the composition given in Example 3 was then applied with a brush in 3 successive layers to the lead plate covered with previously activated titanium sponge particles, followed by drying and heat treatment as described in Example 3.

The sample AL4 thus obtained was likewise tested in an industrial electrolyte as in Examples 2, 3 and exhibited an anode potential AP at 400 A/m$^2$ which was initially 1.47 V/NHE and 1.55 V/NHE after operating for 25 days, without anode failure.

Table 3 above shows the corresponding data for sample AL4.

EXAMPLE 5

A lead sample AL5 was prepared as in Example 2, unless otherwise indicated below.

Sand-blasted zirconium powder with a particle size of about 420 microns (40 mesh) was used in this case.

An activating solution AS2 was applied to the zirconium powder in the manner described under (ii) in Example 1. This was followed by slow drying and heat treating at 320° C. for 15 minutes in air. The activated zirconium powder was obtained by carrying out this procedure of applying solution AS2, drying and heat treatment four times, and then effecting a final prolonged common heat treatment at 320° C. for 240 minutes in air.

The lead sample AL5 obtained after applying the activated zirconium powder as described in Example 1, comprised 150 g Zr/m$^2$ and 5.5 g Ru/m$^2$. It was tested as an oxygen-evolving anode in an industrial electrolyte as described in Example 2, exhibited an anode potential AP of 1.5 V/NHE at 400 A/m$^2$.

Table 3 above shows the corresponding data for sample AL5.

EXAMPLE 6

An anode sample AL6 was prepared in the following manner from a lead plate (20×15×1.5 mm) pretreated as in Example 1.

Titanium powder with a particle size of 300–400 microns was pretreated with hot hydrochloric acid, washed with distilled led water, dried at 80° C. for 30 minutes, and applied to the lead plate as described under (iv) and (v) in Example 1, except that a press was used to partly embed the titanium powder in the lead plate.

An activating solution AS6 comprising 1 g $RuCl_3$ aq. in 6 cc ethanol and 0.0060 g graphite powder uniformly dispersed in the solution, was then applied with a brush in 4 successive layers to the lead plate covered with titanium particles. Each layer of solution AS6 thus applied was dried and then heat treated at 320° for 30 minutes in air.

The anode sample AL6 thus prepared comprised 150 g Ti/m$^2$ and 5 g Ru/m$^2$, was likewise tested in an industrial electrolyte as described in Example 2, exhibited an initial anode potential AP of 1.46 V/NHE at 400 A/m$^2$ and operated at 1.52 V/NHE after 20 days.

Table 3 above shows the corresponding data for sample AL6.

EXAMPLE 7

An anode sample AL7 was prepared in the following manner from a lead plate (20×15×1.5 mm) pretreated as in Example 1.

Titanium powder with a particle size of 430 microns was pretreated as in Example 1.

(i) An activating solution AS7 was prepared comprising 0.10 g $RuCl_3$, 0.3 cc butyltitanate, 0.04 cc HCl, and 6 cc isopropylalcohol.

(ii) After thoroughly mixing 5 grams of the titanium powder with the activating solution, the excess liquid was drained off and the remaining wet powder was slowly dried in air.

(iii) The dry powder thus prepared was next heat treated at 500° C. for 30 minutes in air in a closed furnace.

(iv) The activated titanium powder was then uniformly distributed over the lead plate so as to substantially cover its entire surface on both sides with the activated powder particles.

(v) These particles uniformly arranged in the lead plate were uniformly embedded partly in the underlying lead surface by means of a press.

The amount of activated titanium powder thus applied per unit area of the lead plate corresponded to about 150 g Ti/m$^2$, and 0.5 g Ru/m$^2$.

The solution AS6 described in Example 6 was then applied in four successive layers to the lead plate covered with activated titanium powder particles, and each layer of solution AS6 thus applied was dried and heat treated at 320° C. for 30 minutes in air, and finally at 320° C. for 240 minutes.

The lead sample AL7 thus prepared had 5.5 g Ru/m$^2$ and was likewise tested in an electrolyte as described in Example 2; it exhibited an initial anode potential AP of 1.46 V/NHE at 400 A/m$^2$, and operated with practically no change in potential for 16 days.

Table 3 above shows the corresponding data for sample AL7.

EXAMPLE 8

An anode sample AL8 was prepared from a lead plate (20×15×1.5) in the fllowing manner.

The lead plate surface was pretreated with a 50/50 mixture of acetone and carbon tetrachloride, followed by etching in 5% nitric acid.

Titanium powder with a particle size of 400 to 450 microns was pretreated by degreasing and etching with oxalic acid 10%, washing and drying at 95° C. for 30 minutes, and further activated as follows:

(i) An activating solution AS 8 was prepared, containing 1 g $H_2PtCl_6$, 0.5 g $IrCl_3$, 10 ml isopropylalcohol (IPA) and 10 ml linalol.

(ii) Titanium powder was mixed with the activating solution and the surplus liquid was drained off. The wet powder was slowly dried in air at 80° C. and further heat treated at 480° C. during 30 minutes in a reducing mixture of ammonia and butane in a closed furnace.

The platinum metal salts previously applied on the titanium powder were thus converted into highly electrocatalytically active alloy of 70% platinum and 30% iridium.

(iii) The activated titanium metal powder coated with the above mentioned alloy was further uniformly distributed on the surface of the lead sample, wetting with a very dilute solution of glue in water facilitated this uniform distribution.

(iv) The uniformly distributed powder was pressed and partly embedded in the lead by means of a press heated to 180° C. The amount of titanium powder thus fixed on the lead base corresponded to about 75 g/m$^2$.

In an accelerated test at 2500 A/m$^2$ in a 10% $H_2SO_4$ solution, the sample operated for 5 days with no notable rise in the cell voltage.

EXAMPLE 9

An anode sample AL9 was prepared from a lead alloy plate as in example 1 unless otherwise indicated.

Sand blasted zirconium powder with a particle size of 105 to 840 microns was degreased and pre-etched in warm aqua regia for about 30 minutes, washed with deionized water, and dried at 60° to 70° C. for 30 minutes.

Platinum was electrodeposited on the pretreated zirconium powder on a cathode immersed in ane electroplating bath comprising 7.5 g $KOH_3$ 10 g $K_2Pt(OH)_6$ and 500 cc $H_2O$, and having a temperature of 75°-80° C., and passing an electrolysis current corresponding to 11 mA/cm$^2$ on the cathode for 12 minutes.

The zirconium powder was then pressed into a lead-0.5% silver alloy plate at a pressure of 300 to 500 kg/cm$^2$. The anode produced in this way, containing the equivalent of 40 to 50 g Zr per m$^2$ and 5 g platinum per m$^2$ operated very well in industrial zinc sulfate electrolyte and aqueous sulfuric acid.

TABLE 4

| | | | | EXAMPLES 10 to 13 PREPARATION | | TEST | | | | |
|---|---|---|---|---|---|---|---|---|---|---|
| REFERENCE | BASE | VM Particles (g/m$^2$) | CATALYST (g/m$^2$) | Activating Solution | Heat Treatment (°C./minutes) | ELECTROLYTE | ACD (A/m$^2$) | AP (V/NHE) | VC (V) | Time (days) |
| AL10 | Pb | 400 Ti (sponge 400-615μ 160-400μ) | 1.1 Ir 2.0 Ru 2.2 PAN | 4× AS10 | 4× 250/15 + 420/10 in air, 601/h | $H_2SO_4$ 150 g/l 20° C. | 500 | 1.55 1.61 | | 32* |
| AL11 | Pb | 400 Ti (sponge 400-615μ) | 1.1 Ir 2.0 Ru 2.2 PAN | 4× AS10 | 4× 250/15 + 420/10 in air, 601/h | industrial | 500 | 1.62 1.84 | | 32* |
| AL12 | Pb | 200 Ti (sponge 400-615μ 160-400μ) | 0.55 Ir 1.0 Ru 1.1 PAN | 4× AS10 | 4× 250/15 + 420/10 in air, 601/h | industrial | 500 | 1.65 1.94 | | 32* |
| AL13 | Pb | 300 Ti 200-400μ | 0.8 Ir 1.5 Ru 1.6 PAN | 4× AS10 | 4× 250/15 + 420/10 in air, 601/h | industrial | 500 | 1.59 1.88 | | 32* |

EXAMPLE 10

An anode sample AL10 was produced from a lead plate (80×40×2 mm) in the following manner.

A mixture of titanium sponge particles comprising 5 grams of particles of 400 to 615 microns and 3 grams of particles of 160 to 400 microns was catalytically activated as follows:

(i) An activating solution AS10 was prepared, comprising:
0.022 g Ir (as $IrCl_3$ aq.), 0.040 g Ru (as $RuCl_3$ aq.), 0.080 g polyacrylonitrile (PAN), 6 cc dimethylformamide (DMF) and 3 cc isopropylalcohol (IPA).

(ii) The titanium sponge mixture was immersed in the activating solution AS10 while stirring the solution, the excess of solution was drained off, and the titanium sponge impregnated with solution was dried in air in an oven at 120° C. during 20 minutes.

(iii) The dry mixture was subjected to a first heat treatment (I) effected at 250° C. for 15 minutes in an air flow of 60 l/h. After cooling down to room temperature the titanium sponge was subjected three times more to the same impregnating and drying treatment described under (ii) above, followed by the above first heat treatment (I) at 250° C., and an additional heat treatment (II) was then effected by gradually raising the temperature up to 420° C. within 15 minutes and maintaining the titanium sponge at that temperature for 10 minutes in the same air flow (60 l/h).

(iv) Activated titanium sponge particles thus obtained were dispersed on the lead plate sample so as to substantially form a layer of particles covering the whole surface on one side of the lead plate as evenly as possible.

(v) The activated titanium sponge particles thus evenly arranged on one side of the plate sample were then pressed into the lead surface by applying a plate with a pressure of 250 kg/cm$^2$ for 10 seconds, whereby the particles were partly embedded and firmly anchored in the lead plate.

The amount of activated titanium sponge thus applied to produce an activated lead anode sample AL10 corresponded in this case to 400 grams of activated titanium sponge per square meter of the anode surface, a noble metal loading of 1.1 g Ir/m$^2$, 2.0 g Ru/m$^2$ and a loading of polymeric material applied of 2.2 g PAN/m$^2$.

The resulting activated lead anode sample AL10 was electrolytically tested as an oxygen-evolving anode operating in 150 gpl $H_2SO_4$ at room temperature with an anode current density (ACD) corresponding to 500 A/m$^2$. The sample AL10 operating under these conditions exhibited an anode potential (AP) which was initially 1.55 V/NHE, and 1.61 V/NHE after 32 days of operation, without anode failure.

Table 4 shows the data corresponding to sample AL10.

EXAMPLE 11

An anode sample AL11 was produced and tested in the manner described in Example 10, except that the titanium sponge particles used in this case had a size of 400 to 615 microns (but with a loading of 400 g/m$^2$ as before).

This sample AL11 tested as described in Example 10 exhibited an anode potential (AP) at 500 A/m$^2$, which was initially 1.62 V/NHE and 1.84 V/NHE after 32 days of operation without anode failure.

Table 4 shows the data corresponding to sample AL11.

EXAMPLE 12

An anode sample AL12 was produced and tested in the manner described in Example 10, except that the loading of the activated titanium sponge particles applied to the lead sheet in this case was reduced by one half to 200 g/m$^2$, the noble metal loading being reduced accordingly to 0.55 g IR/m$^2$ and 1.0 g Ru/m$^2$.

This sample AL12 tested as described in Example 10 exhibited an anode potential (AP) at 500 A/m$^2$, which was initially 1.65 V/NHE and 1.94 V/NHE after 32 days of operation, without anode failure.

Table 4 shows the data corresponding to sample AL12.

EXAMPLE 13

An anode sample AL13 was produced and tested in the manner described in Example 10, except that the titanium sponge was in this case replaced by titanium powder with a particle size lying in the range from 200 to 400 microns, while the loading of the activated titanium powder particles applied corresponded to 300 g Ti/m$^2$, 0.8 g Ir/m$^2$, 1.5 g Ru/m$^2$, and 1.6 g PAN/m$^2$.

This sample AL13 tested as described in Example 10 exhibited an initial anode potential (AP) of 1.59 V/NHE at 500 A/m$^2$ and 1.88 V/NHE after 32 days of operation, without anode failure.

Table 4 shows the data corresponding to sample AL 13. As may be seen from the above examples, an anode according to the invention can be fabricated in a simple manner and be used for prolonged evolution of oxygen at a potential which is significantly lower than the anode potential corresponding to oxygen evolution on lead or lead alloy under otherwise similar operating conditions.

It may be noted, that no loss of lead from the base could be observed when testing anode samples according to the invention, as described in the above examples, whereas a notable lead loss could be observed in the electrolyte when testing the lead or lead alloy reference samples under the same conditions.

It has moreover been found that simultaneously applying heat and pressure, when partly embedding the valve metal particles in the lead or lead alloy at the surface of the anode base, can facilitate their fixation, while preventing the particles from being completely embedded in and/or flattened on the base.

It may further be noted that also improvements may well be expected with respect to the above examples by determining the best conditions for providing anodes according to the invention with optimum, stable, electrochemical performance with maximum economy of precious metals.

It is understood that the catalytic particles may be applied and anchored to the lead or lead alloy base of the anode, not only by hammering or by means of a press as described in the examples above, but also by any other means such as pressure rollers for example, which may be suitable for providing the essential advantages of the invention.

The invention provides various advantages of which the following may be mentioned for example:

(a) The anode according to the invention can be operated at a significantly reduced potential, well below that of conventional anodes of lead or lead alloy currently used in industrial cells for electrowinning metals from acid solutions. The cell voltage and hence the energy costs for electrowinning metals may thus be decreased accordingly.

(b) Contamination of the electrolyte and the cathodic deposit by materials coming from the anode can be substantially avoided, since it has been experimentally established that oxygen is evolved on the catalytic particles at a reduced potential, such that the lead or lead alloy of the anode base is effectively protected from corrosion.

(c) Dendrite formation on the cathode may lead to short circuits with the anode and can thereby burn holes into the anode, but this will nevertheless lead to no serious deterioration of the performance of the anode according to the invention, since it operates with oxygen evolution on the catalytic particles at a reduced potential, at which any parts of the lead or lead base which is exposed does not conduct current to the electrolyte, and hence does not undergo notable corrosion.

(d) Conventional lead or lead alloy anodes may be readily converted into improved anodes according to the invention and it thus becomes possible to retrofit industrial cells for electrowinning metals in a particularly simple and inexpensive manner to provide improved performance.

(e) The reduced cell voltage obtained with anodes according to the invention can be readily monitored so as to be able to rapidly detect any notable rise which may occur in the anode potential. The catalytic particles on the lead or lead alloy base may thus be readily either reactivated or replaced whenever this should become necessary.

(f) Platinum group metals can be used as catalysts in an extremely economical manner, by combining then in a very small proportion (e.g. 0.3–0.5%) with valve metal particles applied in a many times larger amount to the anode base of lead or lead alloy. The cost of precious metal may thus be justified by the resulting improvement in anode performance.

(g) Platinum group metals may thus be used in very restricted amounts, and combined with less expensive stable materials.

(h) Other catalysts for oxygen evolution, obtained from non-noble metals, such as e.g. manganese dioxide, may likewise be applied in the form of catalytic particles according to the invention.

(i) Valve metals in the form of a powder, and especially titanium sponge, are much less expensive than when processed into sheets or grids, and may likewise be applied as economically as possible to the anode base.

INDUSTRIAL APPLICABILITY

Anodes according to the invention may be advantageously applied instead of currently used anodes of lead or lead alloy, in order to reduce the energy costs required for electrowinning metals such as zinc, copper, and cobalt industrially, and to improve the purity of the metal produced on the cathode.

Such anodes may be usefully applied to various processes where oxygen evolution at a reduced overvoltage is required.

I claim:

1. An anode for oxygen evolution in an acid electrolyte, comprising an anode base of lead or lead alloy, characterized in that catalytic particles, which have a size lying between about 75 microns and about 850 microns and consist of valve metal to which at least one catalyst for oxygen evolution comprising a platinum group metal is fixed in a small amount lying between 0.3% and 6% by weight of said valve metal, are uniformly distributed on and partly embedded in the surface of the anode base of lead or lead alloy, whereby said catalytic particles are firmly anchored and electrically connected to said anode base, while their remaining, non-embedded part projects from said surface of the anode base, and thereby presents a larger projecting surface than the underlying surface of the anode base of lead or lead alloy, so that oxygen can be evolved on said projecting surface of the partly embedded catalytic particles at a reduced potential at which the underlying lead or lead alloy of said base remains electrochemically inactive and thereby essentially serves as a current-conducting support for said partly embedded catalytic particles of valve metal with a small amount of said catalyst.

2. The anode of claim 1, characterized in that said catalytic particles comprise at least one of the platinum group metals iridium, ruthenium, platinum, palladium and rhodium or oxides thereof.

3. The anode of claim 1, characterized in that the valve metal forming said particles is selected from the group consisting of titanium, zirconium, tantalum, and niobium.

* * * * *